US006308464B1

(12) United States Patent
Demartini

(10) Patent No.: US 6,308,464 B1
(45) Date of Patent: Oct. 30, 2001

(54) REELABLE DOWNSPOUT FOR A RAIN GUTTER

(76) Inventor: Robert J. Demartini, 208 Pineholt La., Flat Rock, NC (US) 28731

( * ) Notice: Subject to any disclaimer, the term of this patent is extended or adjusted under 35 U.S.C. 154(b) by 0 days.

(21) Appl. No.: 09/578,295

(22) Filed: May 25, 2000

(51) Int. Cl.[7] ..... E04D 13/08

(52) U.S. Cl. ..... 52/16; 52/11; 52/217; 138/162; 138/168; 138/166

(58) Field of Search ..... 52/16, 11, 217; 428/906; 138/162, 166, 168

(56) References Cited

U.S. PATENT DOCUMENTS

| | | | | |
|---|---|---|---|---|
| Re. 36,976 | * | 12/2000 | Bezner | 52/563 |
| 2,905,282 | * | 9/1959 | Miller | 52/16 |
| 3,032,151 | | 5/1962 | Allen et al. . | |
| 3,076,669 | * | 2/1963 | Schlein | 52/16 |
| 3,144,104 | | 8/1964 | Weir et al. . | |
| 3,295,556 | | 1/1967 | Gertsma et al. . | |
| 3,434,254 | | 3/1969 | Rubin . | |
| 3,503,164 | | 3/1970 | Berry et al. . | |
| 3,508,587 | | 4/1970 | Mauch . | |
| 3,732,656 | | 5/1973 | Robinsky . | |
| 3,749,133 | | 7/1973 | Bochory . | |
| 3,811,633 | | 5/1974 | Cummings et al. . | |
| 4,019,301 | * | 4/1977 | Fox | 52/727 |
| 4,328,694 | * | 5/1982 | Beaumont | 52/16 |
| 4,663,894 | * | 5/1987 | LaRoche et al. | 52/16 |
| 5,154,025 | | 10/1992 | Brown . | |
| 5,638,643 | | 6/1997 | Demartini et al. . | |
| 5,867,944 | * | 2/1999 | Attaway | 52/16 |
| 6,041,556 | * | 3/2000 | Keller | 52/11 |

OTHER PUBLICATIONS

Pamphlet entitled "TERRAIN The Experts in Rainwater Systems," Aylesford, Kent, England, dated 1994.

* cited by examiner

*Primary Examiner*—Beth A. Stephan
*Assistant Examiner*—Dennis L. Dorsey
(74) *Attorney, Agent, or Firm*—Nelson Mullins Riley & Scarborough

(57) ABSTRACT

A downspout for use with a rain gutter is formed from an elongate member constructed substantially entirely of plastic material. During shipping and storage, the elongate member is maintained in a generally planar configuration that can be coiled on a mandrel. To produce a downspout, a predetermined length of the elongate member is withdrawn from the coil and cut. The elongate member is then configured into a tubular form having a predetermined geometric cross-section, such as a rectangular or oval cross section. Lateral sides of the elongate member define respective connectors that are interlocked to maintain the tubular form.

12 Claims, 6 Drawing Sheets

REELABLE DOWNSPOUT FOR A RAIN GUTTER

BACKGROUND OF THE INVENTION

The present invention relates generally to the art of downspouts utilized in conjunction with rain gutters.

As is well known, rain gutters installed along the roof edge of a house or other structure will collect rainwater as it flows off the roof. Water collected in the rain gutter will then flow into a downspout attached to the side of the house. Preferably, the lower end of the downspout is configured so that discharged water will drain away from the structure in a controlled manner.

In the past, downspouts sold at so-called "home centers" to the do-it-yourself market have typically been produced of aluminum or galvanized steel sheet metal formed in predetermined lengths having a 2×3 inch cross section. For example, ten-foot lengths are typically provided. Because they enclose considerable air, however, shipping and storing downspout lengths is inefficient. Moreover, when an application calls for a length of downspout other than the ten-foot module length, the installer must cut and add increments. This adds labor costs, as well as creating an undesirable joint location.

The rigid nature of a sheet metal downspout also leads to certain difficulties. For example, where a rigid downspout encounters a ledge or other protrusion on the side of a house, short downspout pieces must be custom-made to circumvent them. Besides the labor inefficiencies involved, aesthetics are negatively impacted at the location where the custom-made piece is installed.

SUMMARY OF THE INVENTION

The present invention recognizes and addresses the foregoing disadvantages, and others of prior art constructions and methods. Accordingly, it is an object of the present invention to provide a novel downspout for a rain gutter.

It is a further object of the present invention to provide downspout stock that may be conveniently shipped and handled prior to installation.

It is a particular object of the present invention to provide downspout stock in an indeterminate continuous length that may be easily cut to a desired length at the time of installation.

It is a further object of the present invention to provide a downspout for a rain gutter which is relatively flexible to permit circumvention of minor protrusions.

It is also an object of the present invention to provide a novel method of producing a downspout for a rain gutter.

Some of these objects are achieved by a downspout for use with a rain gutter. The downspout comprises an elongate member constructed substantially entirely of plastic material and having a generally planar configuration. The elongate member includes first and second connectors located on respective lateral sides thereof. The connectors are configured to be interlocked so that the elongate member may be maintained as a tubular form having a predetermined geometric cross-section. Preferably, the elongate member will be coiled on a mandrel from which indeterminate lengths may be provided.

In some exemplary embodiments, the first connector comprises a groove element and the second connector comprises a tongue element matable with the groove element. Alternatively, the first and second connectors may comprise first and second interlocking fingers.

Often, it will be desirable to form the elongate member of at least two plastic materials provided in predetermined portions thereof. The respective plastic materials will have different flexibility properties to facilitate formation of the elongate member into the tubular form. For example, one of the plastic materials forming the elongate member may be a flexible plastic material at bend locations in the tubular form. A semi-rigid plastic material may be provided in locations forming planar sides of the tubular form. In such embodiments, the predetermined geometric cross-section of the tubular form may be a rectangular cross-section.

In other embodiments, one of the plastic materials forming the elongate member may be a semi-rigid plastic material along the lateral sides thereof from which the first and second connectors are formed. A flexible plastic material may be provided in an intermediate main portion of the elongate member, between the lateral sides. In such embodiments, the predetermined geometric cross-section may be an oval cross section.

Other objects of the present invention are achieved by a downspout for use with a rain gutter comprising an elongate member. The elongate member is capable of being configured into either a first flattened configuration for coiling in a long dimension thereof or a second tubular configuration upon being uncoiled. In this case, the elongate member is formed of at least two plastic materials provided in predetermined portions thereof. The respective plastic materials have different flexibility properties to facilitate formation of the elongate member into the second tubular configuration.

In some exemplary embodiments, the elongate member has first and second connectors located on respective lateral sides thereof. For example, the first connector may comprise a groove element and the second connector may comprise a tongue element matable with the groove element. Alternatively, the first and second connectors may comprise first and second interlocking fingers.

One of the plastic materials forming the elongate member may comprise a flexible plastic material at bend locations in the tubular form. The other plastic material may be a semi-rigid plastic material in locations forming planar sides of the tubular form. In such embodiments, the second tubular configuration may have a rectangular cross-section.

Other embodiments are contemplated in which one of the plastic materials forming the elongate member comprises a semi-rigid plastic material along the lateral sides thereof from which the first and second connectors are formed. The other plastic material may comprise a flexible plastic material in an intermediate main portion of the elongate member, between the lateral sides. In such embodiments, the predetermined geometric cross-section may be an oval cross section.

Still further objects of the present invention are achieved by a method of producing a downspout for use with a rain gutter. One step of the method involves providing a coil of an elongate member in a first flattened configuration. Next, a predetermined length of the elongate member is withdrawn from the coil. The predetermined length is then erected into a second tubular form. Finally, the predetermined length of the elongate member, in the second tubular form, is mounted to a rain gutter attached to a structure.

Other objects, features and aspects of the present invention are achieved by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
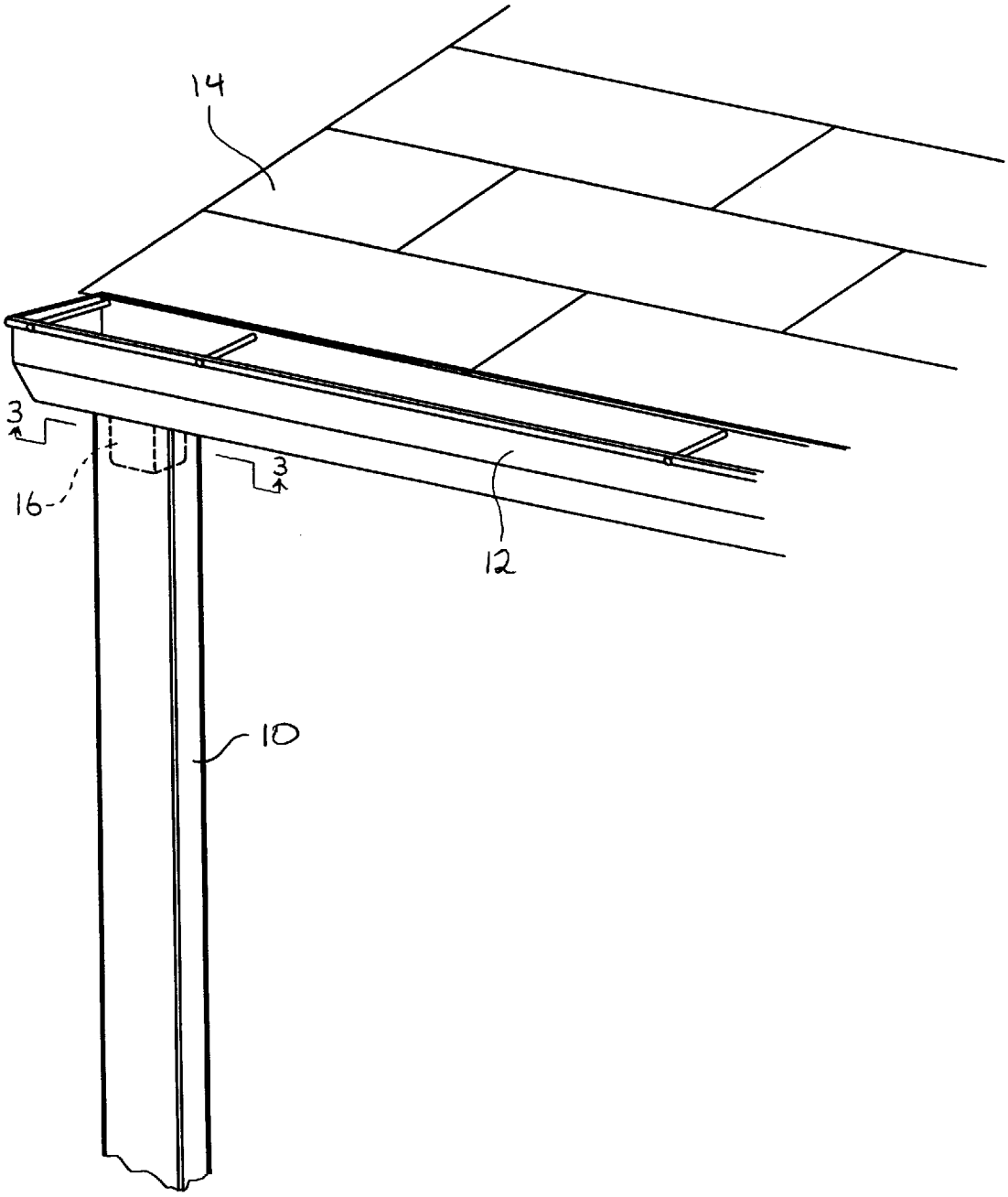
FIG. 1 is a diagrammatic perspective view of a downspout constructed in accordance with the present invention installed in conjunction with a rain gutter.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

FIG. 1 illustrates a downspout 10 of the present invention installed in conjunction with a rain gutter 12. Rain gutter 12 is conventionally positioned to collect rainwater flowing off the roof 14 of a structure such as a house. Gutter 12 includes an outlet port 16 in fluid communication with downspout 10 (either directly as shown or through an interposing elbow piece). At the bottom end of downspout 10, the water is typically discharged so that it will flow away from the structure in a controlled manner. For example, a lower elbow piece may be attached to the bottom of downspout 10 to divert the water away at a 45° angle.

As described above, downspouts of the prior art have typically been constructed of a rigid sheet metal material sold in predetermined lengths. This has often required substantial labor and skill during the installation process. Considerable space has also been required to ship and store quantities of the downspout.

Figure 2:
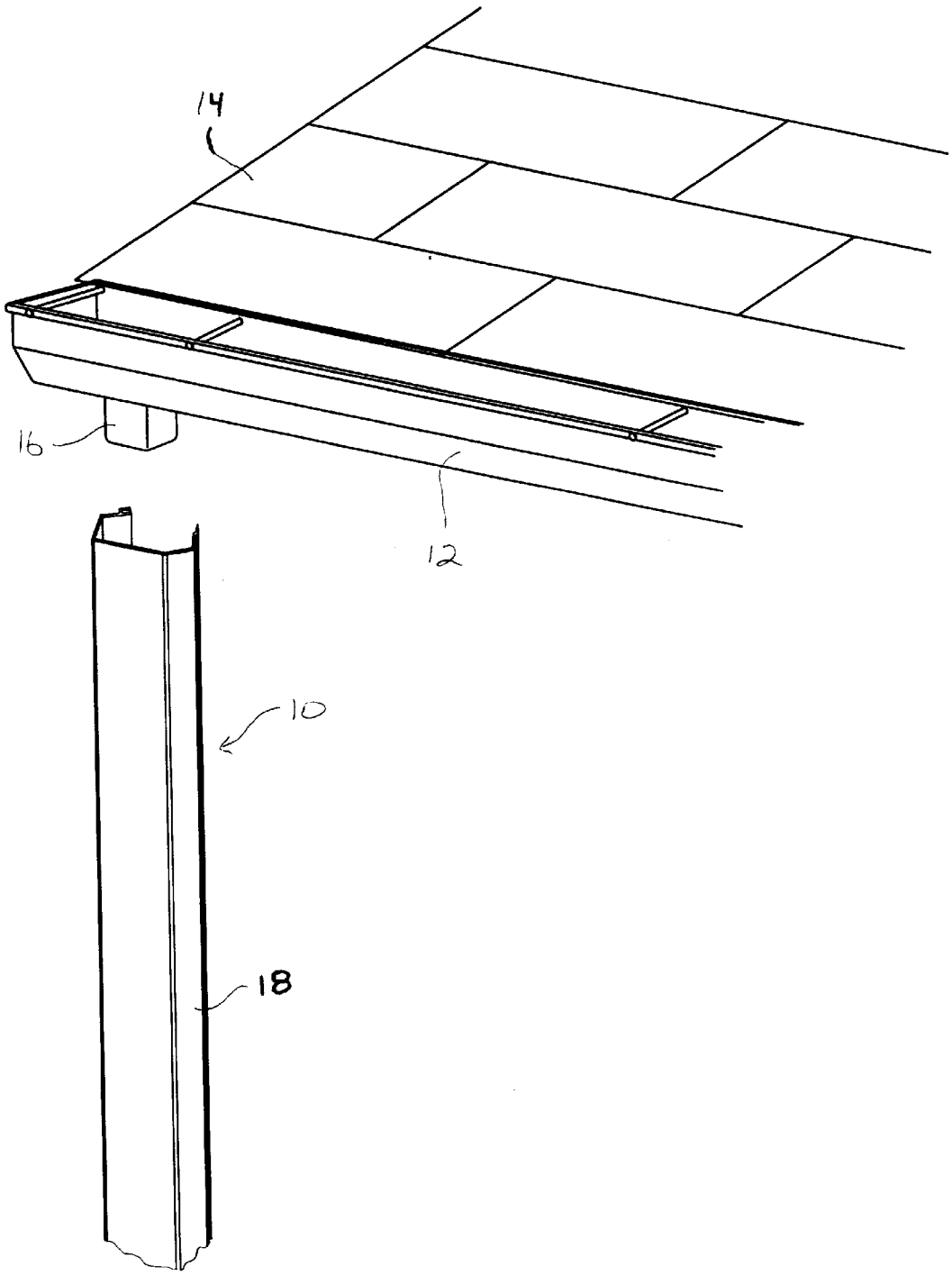
FIG. 2 is a view similar to FIG. 1 showing the edge connectors of the downspout disconnected as they may appear prior to installation.

Referring now to FIG. 2, downspout 10 is constructed in a manner that overcomes these disadvantages of the prior art. As shown, downspout 10 is preferably made from an elongate member 18 constructed substantially entirely of plastic material. For shipping and storing, elongate member 18 is maintained in a generally planar or "flattened" form. At the time of use, elongate member 18 is cut to the desired length and erected into a tubular form. In this embodiment, interlocking connectors are provided along lateral edges (or sides) of elongate member 18 to maintain the tubular form.

Figure 3:
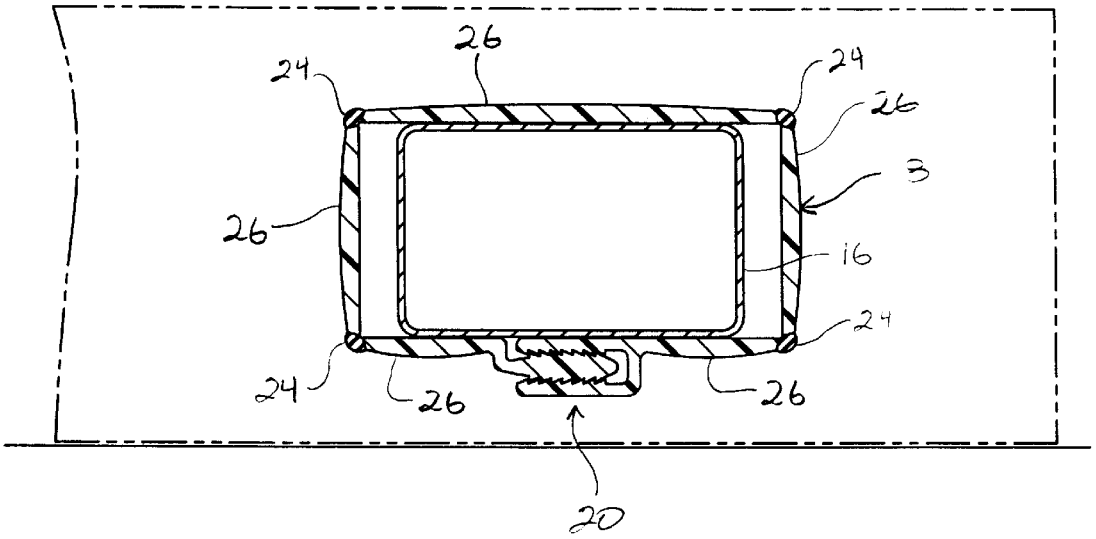
FIG. 3 is a cross-sectional view as taken along line 3—3 of FIG. 1.
Figure 4:
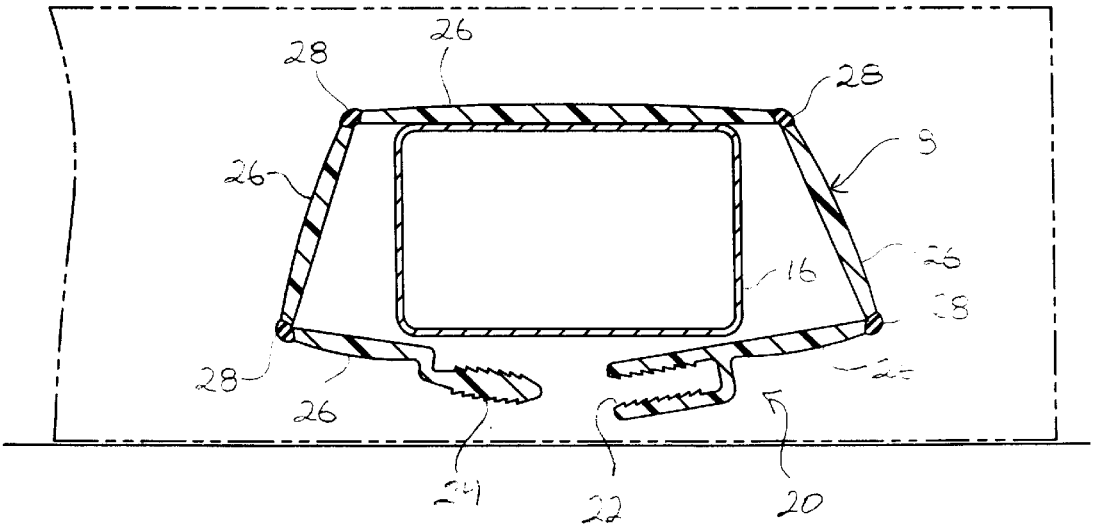
FIG. 4 is a cross-sectional view similar to FIG. 3 showing the edge connectors of the downspout disconnected.

The manner in which elongate member 18 is configured into the tubular form may be most easily explained with reference to FIGS. 3 and 4. In FIG. 3, the interlocking connectors (collectively 20) of elongate member 18 are connected together to show the manner in which the tubular form is maintained. In FIG. 4, interlocking connectors 20 are shown disconnected as they would appear just before the tubular form had been completed.

In the illustrated embodiment, one of the interlocking connectors is formed as an elongated groove 22 having serrated faces situated in opposition to one another. A serrated tongue, indicated at 24, is inserted into the groove to maintain a secure and interlocking connection. It will be appreciated, however, that many other types of interlocking connectors could also be used for this purpose.

Elongate member 18 may be efficiently produced as an axial extrusion of plastic in accordance with known mass production techniques. In the illustrated embodiment, elongate member 18 may be made from at least two disparate plastic materials having different flexibility properties. The resulting structure permits elongate member 18 to be maintained in a planar form until time for use, which can then be manipulated with relative ease into the tubular form.

For example, a semi-rigid plastic material, as indicated at 26, may be provided in the regions of elongate member 18 that will form the planar sides of the tubular form. As indicated at 28, the locations where bends occur in elongate member 18 may be formed of a different, more flexible plastic material. The semi-rigid plastic material may be a semi-rigid PVC and the flexible material may be a flexible PVC, which are simultaneously co-extruded to yield the desired unitary structure. As an alternative to providing a more flexible material at the bend locations, a semi-rigid plastic material may be made thinner where bends are to occur so that the material will be more flexible at these locations.

Figure 5:
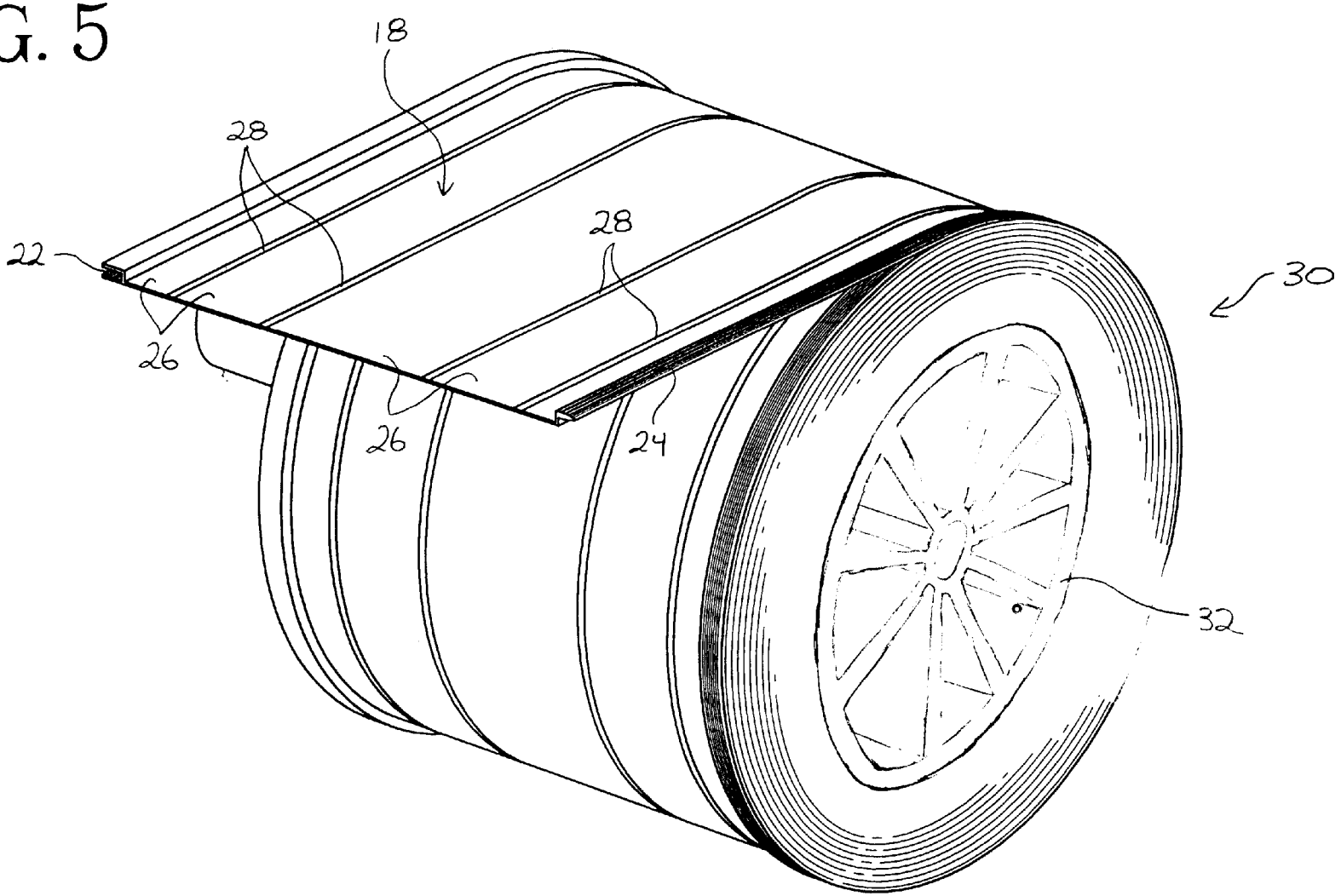
FIG. 5 is a perspective view of the downspout of FIG. 1 as it may appear being supplied in roll form.

Preferably, the semi-rigid plastic material will be flexible enough so that elongate member 18 can be easily coiled when in its flattened state. This is illustrated in FIG. 5, where a coil 30 of elongate member 18 is provided on a suitable mandrel or core 32. When it is desired to produce a downspout, the material is simply unreeled from the coil and cut to the desired length. For example, if the length of a downspout is to be twenty-three feet, a corresponding length of material may be cut. One continuous length of downspout can then be installed instead of two ten-foot lengths and a tailored three-foot piece as may have been required in the past.

PVC is a particularly desirable material from which to produce elongate member 18 due to its excellent "memory" characteristics. Specifically, the material's "memory" facilitates the making of a straight downspout upon being uncoiled. Nevertheless, it will often be desirable for core 32 to have a relatively large diameter, such as 18–20 inches. Winding onto a small-diameter core can induce lengthwise curvature that takes time to relieve after unwinding. Furthermore, there is a relatively small gain in reel capacity by adding small-diameter turns in the coil.

Figure 6:
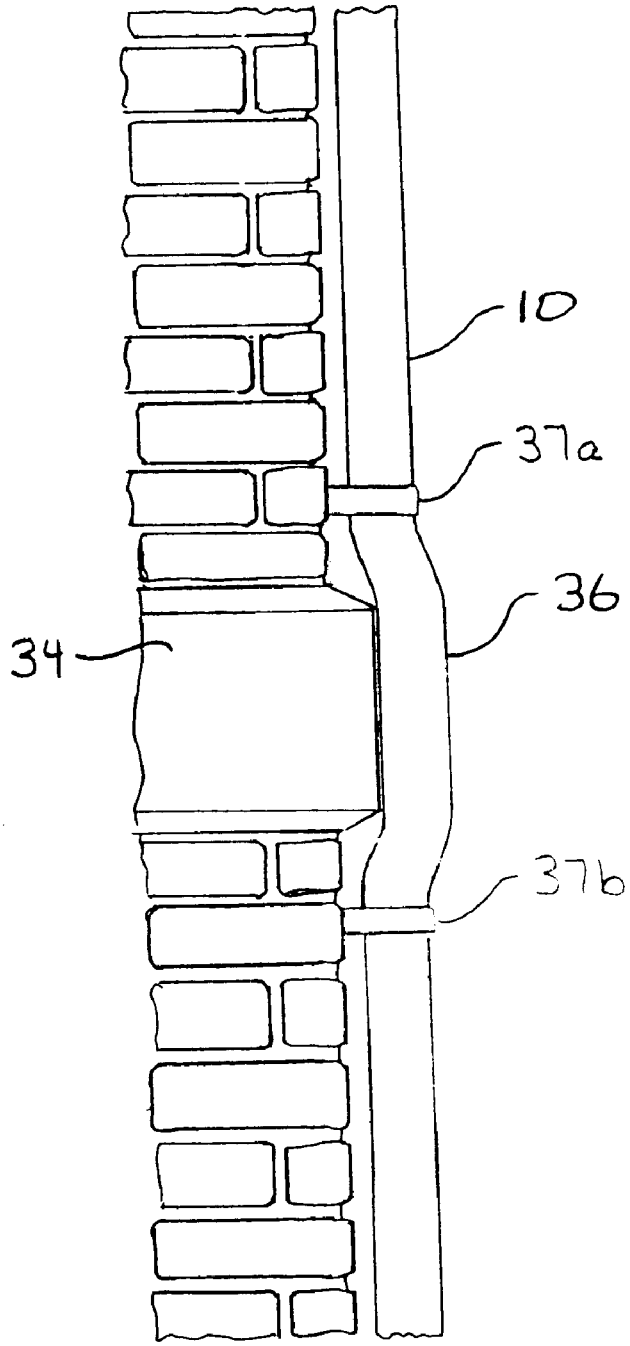
FIG. 6 is an elevational view showing a portion of the downspout circumventing a protrusion due to its flexible nature.

A further advantage of downspout 10 can be explained with reference to FIG. 6. In this case, downspout 10 is attached to the side of a structure having a protrusion 34. Because downspout 10 is made of a plastic material that is at most semi-rigid, it can bend, as indicated at 36, in order to avoid protrusion 34. This is in contrast to the prior art, where it has often been necessary to fabricate special pieces on-site to avoid such protrusions. Preferably, brackets 37*a* and 37*b* are provided above and below the protrusion to restrain downspout 10 and maintain it in position.

Figure 7:
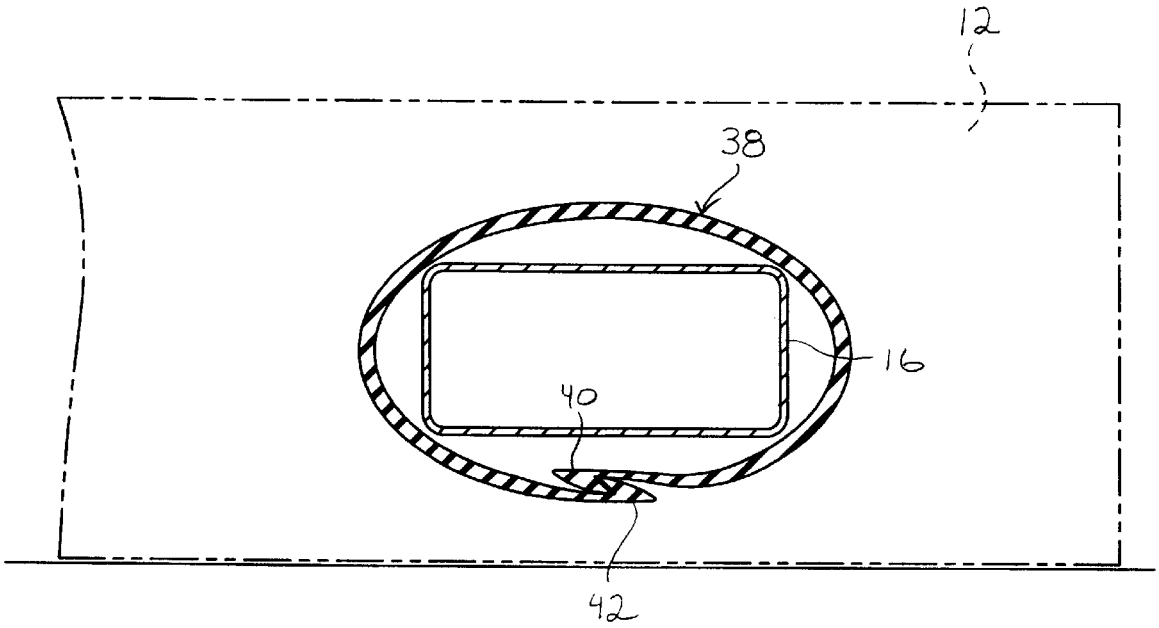
FIG. 7 is a view similar to FIG. 3 showing a first alternative downspout constructed in accordance with the present invention.

FIG. 7 illustrates a first alternative downspout constructed in accordance with the present invention. In this case, an elongate member 38 is formed entirely from a flexible plastic material. In this case, the interlocking connectors comprise a pair of interlocking fingers 40 and 42. As shown, the interlocking fingers connect edges of the normally planar elongate member to produce the tubular form. It can also be seen that the tubular form may have a substantially oval cross section in this example, instead of a rectangular cross section as in the previous embodiment.

In addition to the advantage of manufacturing simplicity, interlocking fingers 40 and 42 will often be desirable due to the relative ease with which they may be connected and disconnected. Disconnection of the interlocking connectors permits the downspout tube to be opened after it has been installed in order to remove debris or other obstructions. In this regard, it should be distinctly understood that interlocking fingers may be used with any embodiment of the downspout, and may also be produced from semi-rigid plastic material if desired.

Figure 8:
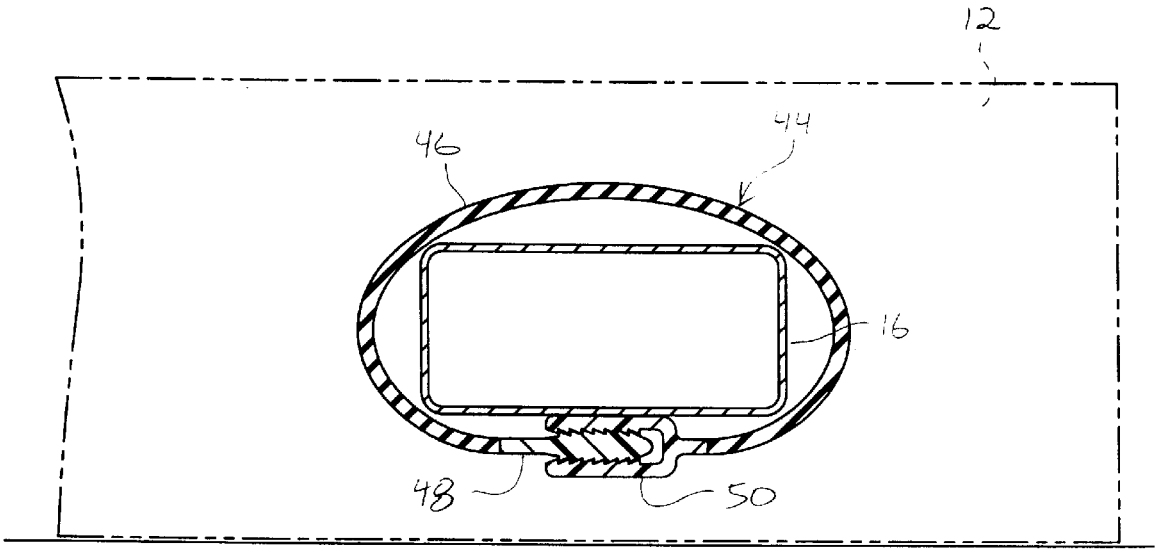
FIG. 8 is a view similar to FIG. 3 showing a second alternative downspout constructed in accordance with the present invention.

A second alternative downspout constructed in accordance with the present invention is shown in FIG. 8. In this case, an elongate member 44 has an intermediate main portion 46 formed of a flexible plastic material. Portions 48 and 50, which define lateral sides of elongate member 44 when planar, may be formed of a semi-rigid plastic material. The semi-rigid plastic defines suitable interlocking connectors, such as the tongue and groove arrangement shown.

It can be seen that various downspout arrangements have been provided in furtherance of the noted objects. While preferred embodiments of the invention have been shown and described, modifications and variations may be made thereto by those of ordinary skill in the art without departing from the spirit and scope of the present invention, which is more particularly set forth in the appended claims. For example, in some cases it may be desirable to form the elongate member as a collapsible tube without interlocking connectors. Such a tube could be made entirely of a flexible plastic material, or a semi-rigid plastic material with flexible plastic material at the bend locations.

In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A combination comprising:

a downspout having a predetermined length, said downspout being configured in a predetermined tubular form to permit flow of water therethrough;

a rain gutter having an outlet for discharging water, said downspout being in fluid communication with said outlet of said rain gutter;

said downspout being formed from an elongate member constructed substantially entirely of plastic material, said elongate member having a generally planar configuration;

said elongate member having first and second connectors located on respective lateral sides thereof; and said elongate member adapted to be configured into said tubular form having a predetermined geometric cross section, said first and second connectors being configured to be interlocked so that said elongate member may be maintained as said tubular form.

2. A combination as set forth in claim 1, wherein said first connector comprises a groove element and said second connector comprises a tongue element matable with said groove element.

3. A combination as set forth in claim 1, wherein said first and second connectors comprise first and second interlocking fingers.

4. A combination as set forth in claim 1, wherein said elongate member is formed of at least two plastic materials provided in predetermined portions thereof, said at least two plastic materials having different flexibility properties to facilitate formation of said elongate member into said tubular form.

5. A combination as set forth in claim 4, wherein said at least two plastic materials forming said elongate member comprise a flexible plastic material at bend locations in said tubular form and a semi-rigid plastic material in locations forming planar sides of said tubular form.

6. A combination as set forth in claim 5, wherein said predetermined geometric cross section is a rectangular cross section.

7. A combination as set forth in claim 4, wherein said at least two plastic materials forming said elongate member comprise a semi-rigid plastic material along said lateral sides thereof from which said first and second connectors are formed and a flexible plastic material in an intermediate main portion of said elongate member between said lateral sides.

8. A combination as set forth in claim 7, wherein said predetermined geometric cross section is an oval cross section.

9. A combination as set forth in claim 1, wherein said plastic material is a PVC material.

10. A method of producing a downspout for use with a rain gutter, said method comprising steps of:

(a) providing a coil of an elongate member in a first flattened form;

(b) withdrawing a predetermined length of said elongate member from said coil;

(c) separating said predetermined length of said elongate member from a remainder of said coil;

(d) erecting said predetermined length of said elongate member into a second tubular form; and (e) mounting said predetermined length of said elongate member in said second tubular configuration to a rain gutter attached to a structure such that said predetermined length defines a long dimension of said downspout.

11. A method as set forth in claim 10, wherein said elongate member has first and second connectors located on respective lateral sides thereof and said elongate member is erected into said second tubular configuration by interconnecting said first and second connectors.

12. A method as set forth in claim 10, wherein said predetermined length of said elongate member is separated in step (c) from said remainder of said coil by cutting.

* * * * *

UNITED STATES PATENT AND TRADEMARK OFFICE

CERTIFICATE OF CORRECTION

PATENT NO. : 6,380,464 B1
APPLICATION NO. : 09/454034
DATED : April 30, 2002
INVENTOR(S) : Gary M. Fader It is certified that error appears in the above-identified patent and that said Letters Patent is hereby corrected as shown below:

On the tile page item (75), delete "Stephen M. Allen, Wilmington, DE (US);".

Column 6, line 20: delete "," after the word identification.

Column 6, line 21: delete "," and insert therefor --;--.

Column 6, line 26: delete "," after the word gene and insert therefor --.--.

Column 6, line 35: delete "portio" and insert therefor --portion--.

Column 15, line 13: delete "." after the word Search and delete "," after the abbreviation al and replace with --.--.

Claim 2, line 9 replace "herein" with --wherein--.

Signed and Sealed this

Twenty-ninth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,308,464 B1
APPLICATION NO. : 09/578295
DATED : October 30, 2001
INVENTOR(S) : Robert J. Demartini It is certified that error appears in the above-identified patent and that said Letters Patent is hereby corrected as shown below:

This certificate supersedes Certificate of Correction issued August 29, 2006, the number was erroneously mentioned and should be vacated since no Certificate of Correction was granted for this patent number.

Signed and Sealed this

Fourteenth Day of November, 2006

JON W. DUDAS
*Director of the United States Patent and Trademark Office*